US006109996A

United States Patent [19]

Ma et al.

[11] Patent Number: 6,109,996

[45] Date of Patent: Aug. 29, 2000

[54] COIN BANK HAVING TWISTABLE SEGMENTS

[76] Inventors: Ben H. Ma, 1433 Mural Dr., Clairmont, Calif. 91711; Paul Wang, 13620 Benson Ave., Chino, Calif. 91710

[21] Appl. No.: 09/252,751

[22] Filed: Feb. 19, 1999

[51] Int. Cl.[7] ..... A45C 1/12

[52] U.S. Cl. ..... 446/8; 70/289

[58] Field of Search ..... 70/63, 159, 287, 70/288, 289; 232/1 D; 446/8

[56] References Cited

U.S. PATENT DOCUMENTS

| | | | |
|---|---|---|---|
| 615,381 | 12/1898 | Brockett | 70/289 |
| 761,254 | 5/1904 | Rosedale | 70/289 |
| 1,266,647 | 5/1918 | Wickberg | 70/289 |
| 2,007,831 | 7/1935 | Neitz et al. | 448/8 X |
| 2,125,419 | 8/1938 | Birk | 70/289 X |
| 2,128,399 | 8/1938 | Cardone | 70/289 X |
| 3,298,601 | 1/1967 | Brown | 446/8 X |
| 4,871,112 | 10/1989 | Emslie | 446/8 X |
| 5,055,079 | 10/1991 | Hobson et al. | 446/8 |

FOREIGN PATENT DOCUMENTS

| | | | |
|---|---|---|---|
| 208634 | 11/1966 | Sweden | 446/8 |

*Primary Examiner*—John A. Ricci
*Attorney, Agent, or Firm*—Steins & Associates

[57] ABSTRACT

A Coin Bank Having Twistable Segments is disclosed. Also disclosed is a bank that has a lockable lid and a plurality of twistable segments, such that when the segments are aligned in the proper rotational position in relation to the throat and base of the bank, then the lid will be unlocked. The bank includes a lid that is hinged and further is defined by a slot formed therethrough for inserting thin objects, such as coins, through the slot and into the bank. The bank also includes a coin detector for detecting when a coin is placed into the slot, and responsively playing sounds perceptible to the human ear. Furthermore the segments are formed from circular rings having artwork or other indexing markings on their outer surface, such that when the artwork or indexing markings are aligned, then the segments are aligned with the non-rotating base, and the lid can be unlocked.

18 Claims, 4 Drawing Sheets

COIN BANK HAVING TWISTABLE SEGMENTS

BACKGROUND OF THE INVENTION

1. Field of the Invention

This invention relates generally to money storage containers and, more specifically, to a Coin Bank Having Twistable Segments.

2. Description of Related Art

"Piggy" banks and other coin banks have been used, particularly by children, to contain, safeguard, and many times hide cash (usually in the form of coins). Most coin banks include some way of preventing unauthorized persons from gaining access to the cash—these are locking coin banks. The problem with locking coin banks is that they have typically been either: (1) key-locked, or (2) combination-locked. While older children and adults are fully capable of working with key- or combination-locked banks, they are not very suitable for small children. Small children are generally incapable of operating a combination-locked bank, and invariably the combination is lost or forgotten, and the bank must be broken into. As for a key-locked bank, the parents of the small children must usually be the "keeper of the key", since these small items are easily lost. What is needed is a bank that can be locked and unlocked by a small child.

SUMMARY OF THE INVENTION

In light of the aforementioned problems associated with the prior devices, it is an object of the present invention to provide a Coin Bank Having Twistable Segments. The preferred bank should have a lockable lid and a plurality of twistable segments, such that when the segments are aligned in the proper rotational position in relation to the throat and base of the bank, then the lid will be unlocked. It is an object that the lid be hinged and further be defined by a slot formed therethrough for inserting thin objects, such as coins, through the slot and into the bank. It is a further object that the bank include coin detector means for detecting when a coin is placed into the slot, and responsively playing sounds perceptible to the human ear. It is a still further object that the segments are formed from circular rings having artwork or other indexing markings on their outer surface, such that when the artwork or indexing markings are aligned, then the segments are aligned with the non-rotating base, and the lid can be unlocked.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the generic principles of the present invention have been defined herein specifically to provide a Coin Bank Having Twistable Segments.

Figure 1:
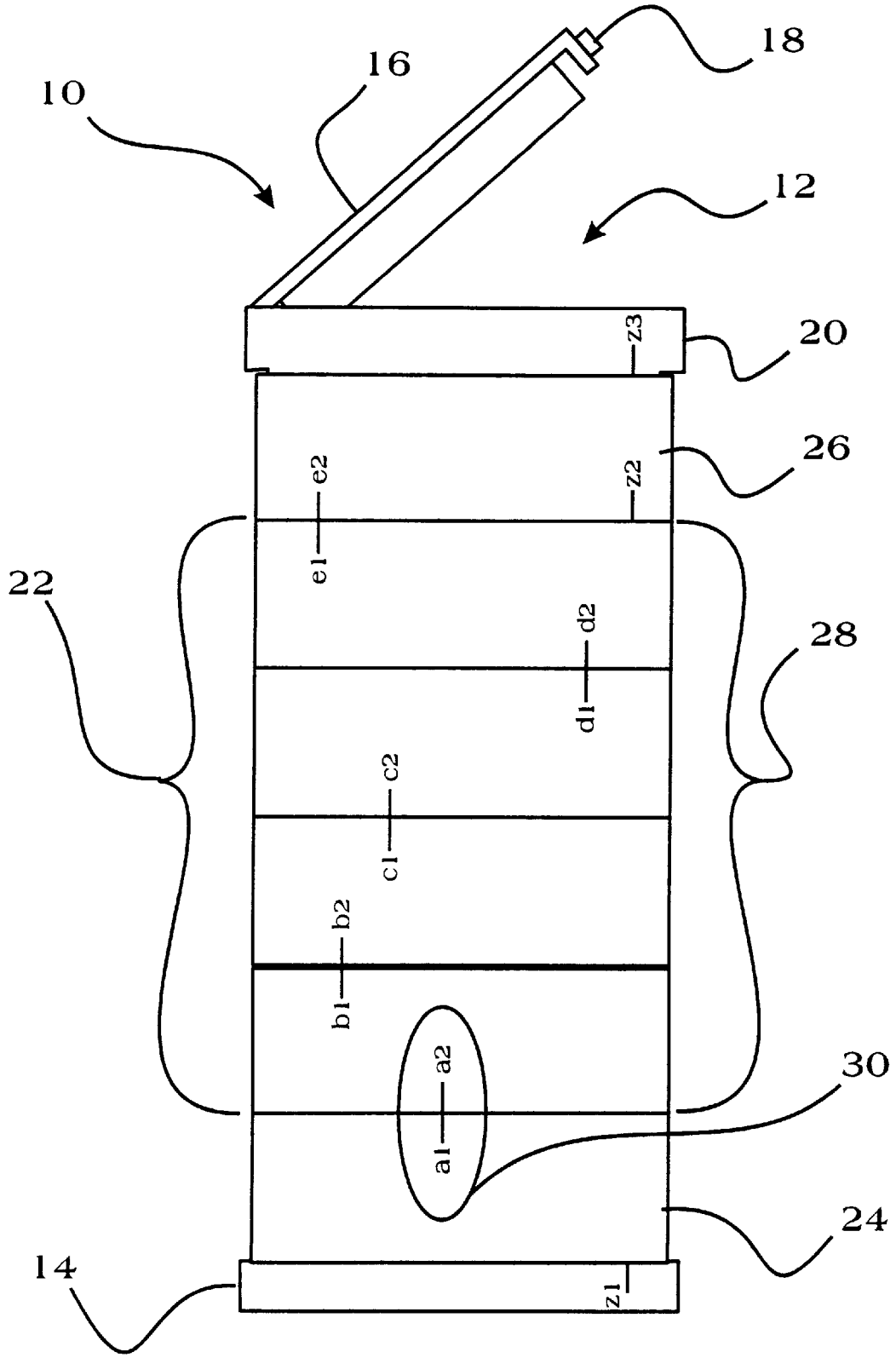
FIG. 1 is a side view of a preferred coin bank of the present invention.

The present invention can best be understood by initial consideration of FIG. 1. FIG. 1 is a side view of a preferred coin bank 10 of the present invention. The bank 10 defines a chamber 12 comprising a base 14 and a lockable lid 16. The lid 16 is manually releasable through operation of the release knob 18. When the lid 16 is ajar (as shown), coins, cash and other thin coin-like objects can be inserted or removed from the chamber 12 through the throat 20.

The lid 16 is lockable once closed (i.e. inserted into the throat 20) via the operation of a unique operation of twistable segments 22 and the release knob 18. The bank 10 can be found in a variety heights and configurations, but, generally includes a bottom segment 24 which is non-twistable (i.e. it is rotationally fixed relative to the base 14 and throat 20). The bank 10 further includes a top segment 26, which is twistable. The object of the bank 10 is to rotationally position the top segment 26 in the proper orientation, such that the lid 16 is unlocked. The unique challenge provided by this bank 10 is that there is no reference or alignment feature between the top segment 26 and the throat 20—the alignment features z1, z2 and z3 are virtual, and are provided to permit a better understanding of the benefits of the present design.

To determine the proper positioning of the top segment 26, the user starts by aligning the a1/a2 alignment feature pair 30. Once these are aligned, the b1/b2 feature pair is aligned. Next, the c1/c2 pair is aligned, after which the d1/d2 are aligned. Finally, the e2 feature is aligned with the e1 feature, which in turn results in the z2 virtual alignment feature to be aligned with the z1 and z3 virtual features. Essentially, therefore, in order to align the virtual alignment features z1–z3 (and unlock the lid 16), the child must align the middle segments 28, from which the top segment 26 can receive a feature to align with. It should be obvious that the alignment features a–e are shown as tic-marks for expository reasons only. In practice, the alignment features might be provided by a graphic, photograph or other artwork design on the outer surface of the segments. Furthermore, the alignment features might be provided in raised (or etched) designs or carvings to the surface of the segments. In any case, the critical aspect of the present invention is the requirement that the twistable segments 22 be dependent upon one another for alignment of the top segment 26. It should also be appreciated that the quantity of middle segments 28 that might included is very flexible, to serve in a wide variety of applications.

Figure 2:
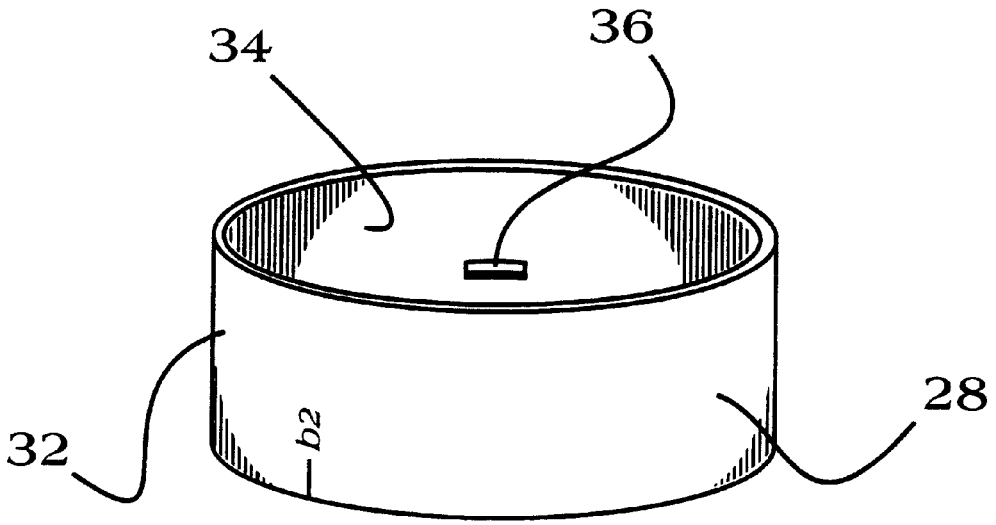
FIG. 2 is a perspective view of a preferred twistable segment of the bank of FIG. 1.

FIG. 2 is a perspective view of a preferred twistable segment 28 of the bank of FIG. 1. The segment 28 has an alignment feature b2, for example, on its outer surface 32. As discussed above, the alignment feature might actually be a graphic design displayed around the circumference of the outer surface 32. On the inner surface 34 is found a tab 36. As will be fully discussed below in connection with FIG. 4, the tab 36 is provided to cooperate with other elements of the bank (see FIG. 1) to permit (or prevent) the twisting of the segment.

Figure 3:
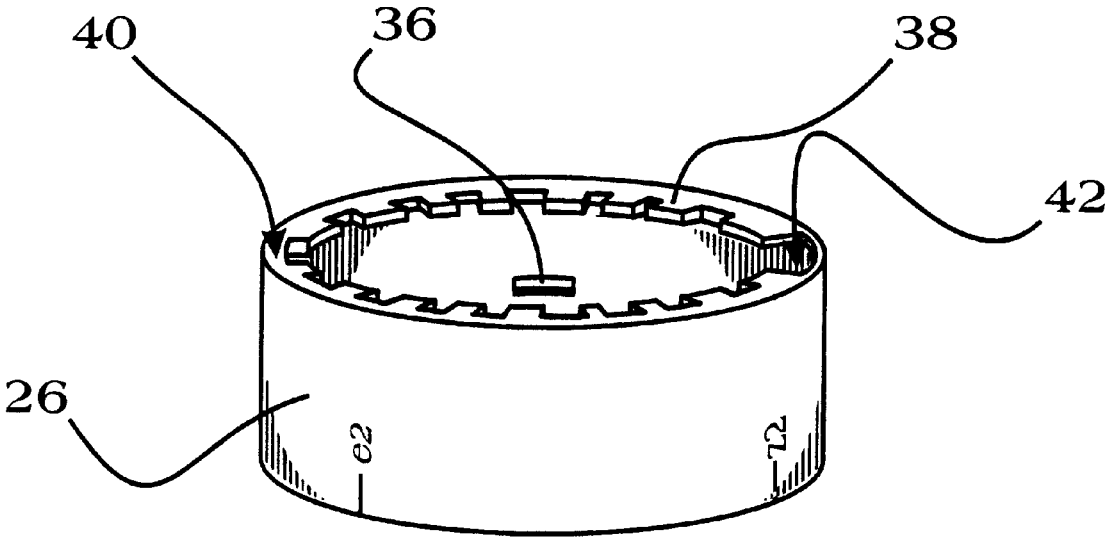
FIG. 3 is a perspective view of the preferred top segment of the bank of FIGS. 1 and 2.

FIG. 3 is a perspective view of the preferred top segment 26 of the bank of FIGS. 1 and 2. The top segment 26 also has a tab 36 protruding from its inner surface, as well as an alignment feature or features. Unlike the other segments, the top segment includes an inwardly-extending ridge 38 around its upper rim 40. Furthermore, the preferred top segment 26 includes a keyway 42 formed in the ridge 38. The keyway 42 cooperates with the release knob (see FIG. 1) to provide the locking and unlocking capability. The operation of the locking capability is more fully discussed below in connection with FIGS. 5 and 6. It should be appreciated that while the segments shown here are circular, other more complex shapes might also be used on the outer surfaces of the segments, so long as the inner surfaces are substantially circular to permit rotation of the segment(s).

Figure 4:
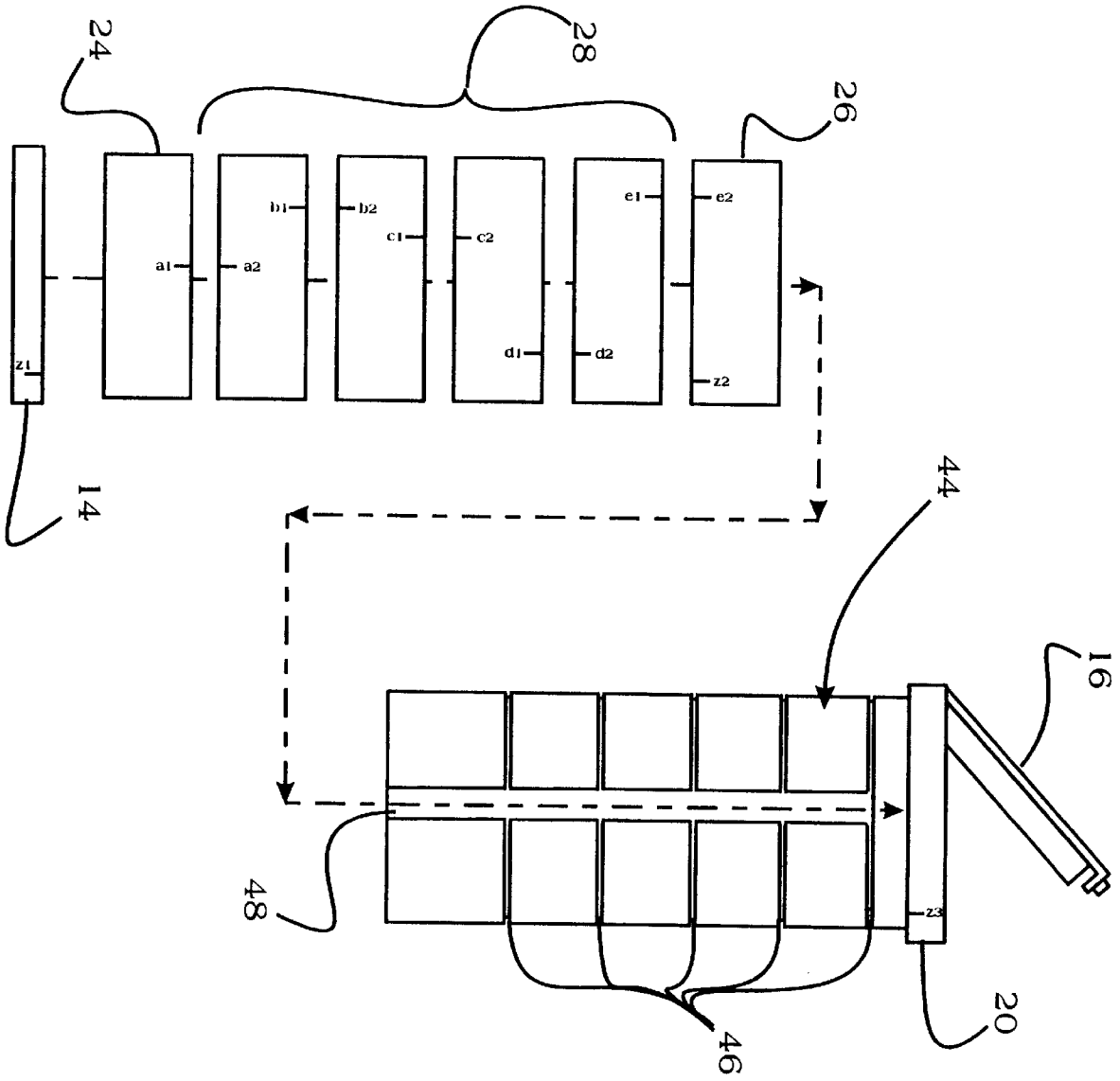
FIG. 4 is an exploded side view of the coin bank of FIGS. 1 and 2.

FIG. 4 is an exploded side view of the coin bank of FIGS. 1 and 2, provided to demonstrate how the preferred bank is assembled. As can be seen, the bank comprises a chamber shell 44, in which are formed a plurality of transverse grooves 46, each running around the entire circumference of the chamber shell 44. The transverse grooves 46 cooperate with the tabs (see FIGS. 2 and 3) to permit the top segment 26 and middle segments 28 to be twisted. As should be noticed, there is no transverse groove 46 provided for the bottom segment 24—as a result, the bottom segment 24 will be prevented from twisting relative to the chamber shell 44. Consequently, the bottom segment 24 will remain in the same position relative to the chamber shell 44 and, of course, the throat 20 and lid 16. The chamber shell 44 further has a longitudinal groove 48 formed along substantially its entire length. The longitudinal groove 48 is provided to permit the segments to be slipped over the chamber shell 44 during the assembly of the bank. Once all of the segments are installed, the base 14 is attached to the open end of the chamber shell 44, thereby closing off the chamber.

Figure 5:
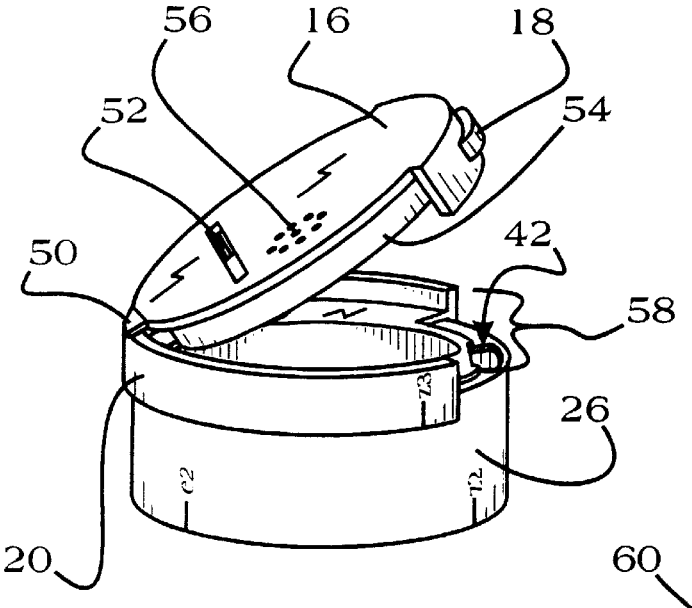
FIG. 5 is a side perspective view of the lid and throat area of the bank of FIGS. 1 and 2.
Figure 6:
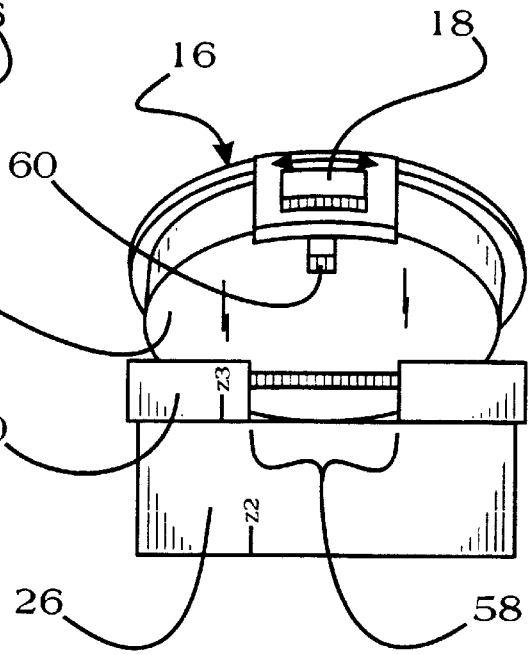
FIG. 6 is a front view of the lid and throat area of the bank of FIGS. 1 and 2.
Figure 7:
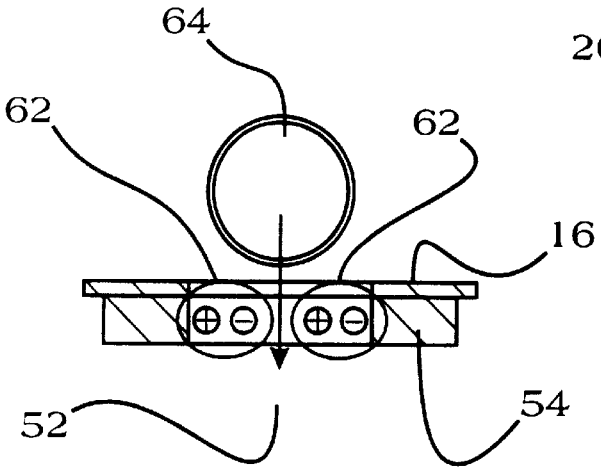
FIG. 7 is a partial cutaway front view of the lid and effects module of the bank of FIGS. 1 and 2, depicting a preferred coin detector means.

Now turning to FIGS. 5–7, we can discuss the novel features of the lid 16 and associated structure. FIG. 5 is a side perspective view of the lid 16 and throat area of the bank of FIGS. 1 and 2. As can be seen, the lid 16 is attached to the throat 20 by a hinge 50 to permit the lid 16 to be opened and closed. The lid 16 is further defined by an effects module 54 on its under-side and a coin slot 52 penetrating the lid 16 and effect module 54, so that coins or other thin objects might be placed in the bank when the lid 16 is closed. The lid 16 might also include a sound-producing means 56 on its upper surface, such as a speaker for playing music responsive to a coin or other thin object being placed into the bank through the coin slot 52. The apparatus providing the sound or music is preferably contained within the effects module 54, and functions as described below in connection with FIG. 7. As can be seen, the throat 20 has a gap 58 in it, such that when the keyway 42 of the top segment 26 is aligned with the gap 58, the release knob 18 will be released, thereby permitting the lid 16 to be opened or closed.

FIG. 6 is a front view of the lid and throat area of the bank of FIGS. 1 and 2. As should be understood, the release knob 18 can travel in the direction of the arrow shown, and further includes a finger latch 60 for engaging the ridge in the top segment 26 (see FIG. 3).

Finally turning to FIG. 7, we can examine the operation of the effects module 54. FIG. 7 is a partial cutaway front view of the lid 16 and effects module 54 of the bank of FIGS. 1 and 2. Essentially, the coin slot 52 is equipped with coin detector means 62, such that when a coin 64 is dropped into the coin slot 52, an electrical circuit is closed. Momentary closure of the electrical circuit will initiate music or other sounds to be played from the sound-producing means 56. Other means for detecting a coin's presence might be used, including simple contact switches or even optical sensors.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A lockable container for cash and other small, thin items, comprising:

a chamber having a lockable lid and defined by an outer surface and a base defining a bottom alignment feature;

a twistable middle section comprising at least one middle segment, said middle section defining first and second middle alignment features; and a twistable top segment defining a top alignment feature, whereby twisting said top segment and said middle section until said first middle alignment feature is aligned with said bottom alignment feature and said top alignment feature is aligned with said second middle alignment feature unlocks said lid, said lid further comprising a hinge for hingably opening said lid.

2. The chamber of claim 1, wherein said lid further comprises an inner surface and an outer surface and a coin slot formed to penetrate said lid and connect said outer surface with said inner surface.

3. The chamber of claim 2, further comprising coin detector means for detecting when a coin is placed in said coin slot.

4. The chamber of claim 3, wherein said lid further comprises an effects module, said effects module comprising sound producing means for producing an alert perceptible to the human senses when a coin is placed in said coin slot.

5. The chamber of claim 4, wherein:

said segments are defined by respective outer surfaces; and said alignment features are created by a segmented graphic displayed on said outer surfaces of said segments.

6. The chamber of claim 5, wherein:

said top segment defines a keyway; and said lid further comprises a finger latch, whereby said lid is unlocked when said keyway is aligned with said finger latch.

7. The chamber of claim 6, wherein:

said chamber defines an elongate cylindrical outer surface; and said segments comprise circular rings configured to slip over said chamber outer surface.

8. The chamber of claim 7, further comprising a bottom segment fixed to said base, and wherein said middle section comprises four twistable segments.

9. A coin bank for receiving cash, comprising:

a coin chamber having a lockable lid and defined by an outer surface and a base defining a bottom alignment feature;

a twistable middle section comprising at least one middle segment, said middle section defining first and second middle alignment features; and a twistable top segment defining a top alignment feature, whereby twisting said top segment and said middle section until said first middle alignment feature is aligned with said bottom alignment feature and said top alignment feature is aligned with said second middle alignment feature unlocks said lid, said lid further comprising a hinge for hingably opening said lid.

10. The bank of claim 9, wherein said lid further comprises an inner surface and an outer surface and a coin slot formed to penetrate said lid and connect said outer surface with said inner surface.

11. The bank of claim 10, further comprising coin detector means for detecting when a coin is placed in said coin slot.

12. The bank of claim 11, wherein:

said chamber defines an elongate cylindrical outer surface; and said segments comprise circular rings configured to slip over said chamber outer surface.

13. The bank of claim 12, wherein said lid further comprises an effects module, said effects module comprising sound producing means for producing an alert perceptible to the human senses when a coin is placed in said coin slot.

14. The bank of claim 13, wherein:

said segments are defined by respective outer surfaces; and said alignment features are created by a segmented graphic displayed on said outer surfaces of said segments.

15. The bank of claim 14, wherein:

said top segment defines a keyway; and said lid further comprises a finger latch, whereby said lid is unlocked when said keyway is aligned with said finger latch.

16. The bank of claim 15, wherein:

said chamber defines an elongate cylindrical outer surface; and said segments comprise circular rings configured to slip over said chamber outer surface.

17. The bank of claim 16, further comprising a bottom segment fixed to said base, and wherein said middle section comprises four twistable segments.

18. The bank of claim 17, wherein:

said segments are further defined by respective inner surfaces and a tab extending transversely inwardly from said respective inner surfaces; and said outer surface of said chamber is further defined by a longitudinal groove for cooperating with said tabs to permit said segments to be slipped over said outer surface, and a plurality of circumferential grooves in spaced relation to one another for cooperating with said tabs to permit selected said segments to be twistable.

* * * * *